United States Patent [19]

NG et al.

[11] Patent Number: 4,518,469

[45] Date of Patent: May 21, 1985

[54] METHOD OF MAKING NON-PRECIOUS METAL ELECTRICAL CONTACTS BY ELECTROPLATING

[75] Inventors: Sau-Lan L. NG, Lawrence Township, Mercer County; John T. Plewes, Chatham Township, Morris County; Murray Robbins, Berkeley Heights Township, Union County, all of N.J.

[73] Assignee: AT&T Technologies, Inc., New York, N.Y.

[21] Appl. No.: 646,665

[22] Filed: Aug. 31, 1984

[51] Int. Cl.[3] ..... C25D 3/56

[52] U.S. Cl. ..... 204/44.5; 200/266; 204/43.1; 420/441; 420/576

[58] Field of Search ..... 204/43.1, 44.5, 123; 420/441, 576; 200/266

[56] References Cited

U.S. PATENT DOCUMENTS

| | | | |
|---|---|---|---|
| 2,095,302 | 10/1937 | Woodford et al. | 420/576 X |
| 2,823,176 | 2/1958 | Breining et al. | 204/43.1 X |
| 2,867,550 | 1/1959 | Weber | 420/576 X |

FOREIGN PATENT DOCUMENTS

| | | | |
|---|---|---|---|
| 15768 | 5/1973 | Japan | 420/441 |
| 415329 | 2/1974 | U.S.S.R. | 420/576 |

*Primary Examiner*—G. L. Kaplan

*Attorney, Agent, or Firm*—Joel F. Spivak

[57] ABSTRACT

A method for electroplating a nickel-antimony alloy comprising from 1–70 weight percent antimony and the balance nickel comprises electroplating the alloy from a solution containing a soluble nickel salt and a soluble mixed antimony alkali metal salt of a polybasic organic acid at a pH in the range of about from 1 to 6. The substrate to be plated is made the cathode and an inert anode is employed.

18 Claims, 5 Drawing Figures

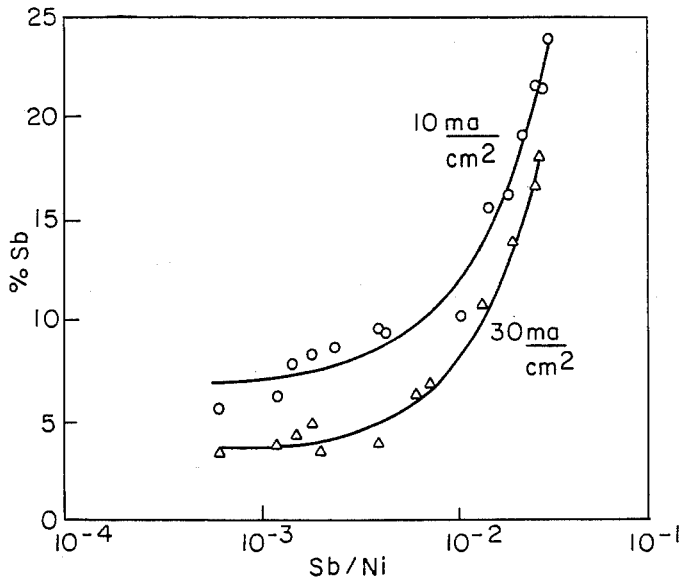
Figure I
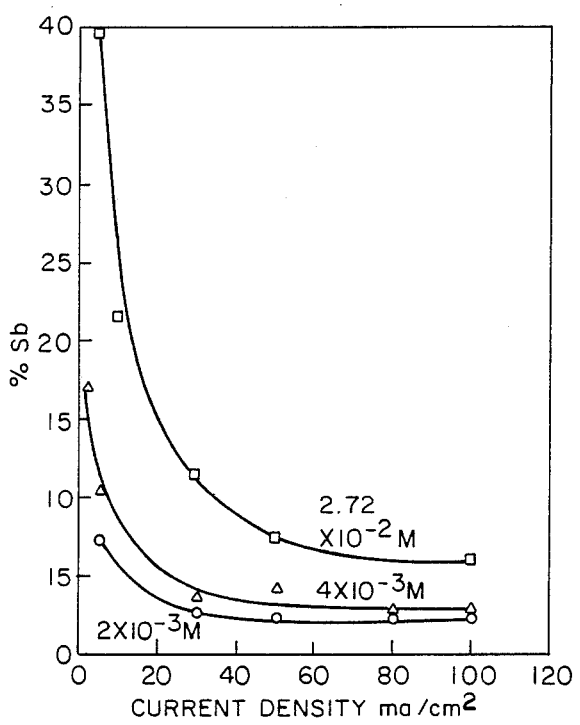
Figure 2

METHOD OF MAKING NON-PRECIOUS METAL ELECTRICAL CONTACTS BY ELECTROPLATING

TECHNICAL FIELD

This invention relates to non-precious metal electrical contacts and particularly to nickel-antimony alloy compositions for electrical contacts and methods of making such compositions.

BACKGROUND OF THE INVENTION

Generally, for a material to be suitable for use as an electrical contact, it should be non-fusing with a mating contact material and have a low, ohmic, contact resistance with a relatively small contact pressure. In addition, the material must be capable of maintaining the low resistance after a large number of operations over an extended life period and be corrosion resistant.

Among the contact materials employed in the past are the precious metals such as gold, palladium and platinum and alloys of such metals with each other as well as with metals such as silver and nickel. Due to the high cost of precious metals, a large effort has been employed to find contact materials which are substantially cheaper than the precious metals but which also possess all or many of the properties of the precious metals as mentioned above and, for certain applications, are also solderable.

Marcus et al., in U.S. Pat. No. 4,361,718, have reported the use of a nickel-antimony alloy as a contact material over the N-type region of the silicon solar cell. The particular alloy is a 50—50 mixture of nickel and antimony so as to give the compound nickel antimonide and is applied as a powder in the form of a thick film over the solar cell.

The present invention also deals with nickel-antimony alloys for use as contact materials. However, in accordance with the present invention the nickel antimony alloys employed are in the form of thin, uniform bright metallic looking films over a substrate. These films are generally formed by electroplating.

SUMMARY OF THE INVENTION

A method for electroplating a nickel-antimony alloy comprising from 1–70 weight percent antimony and the balance nickel comprises electroplating the alloy from a solution containing a soluble nickel salt and a soluble mixed antimony alkali metal salt of a polybasic organic acid at a pH in the range of about from 1 to 6. The substrate to be plated is made the cathode and an inert anode is employed.

Nickel-antimony films made by the above method and having from 1–20% antimony in the film are particularly suitable for use as a solderable, corrosion resistant, low electrical resistance contact material over a base metal or semiconductor.

BRIEF DESCRIPTION OF THE DRAWINGS

FIG. 1 is a plot showing the effect of the electroplating bath composition on the composition of the nickel-antimony deposit. The graph is a plot of the percent antimony in the deposit versus the ratio of antimony to nickel in the electrolytic bath for current densities of both 10 milliamps/cm$^2$ and 30 milliamps/cm$^2$;

FIG. 2 is a graph showing the effect of current density on the composition of deposits at different concentrations of potassium antimony tartrate;

DETAILED DESCRIPTION

Figure 3:
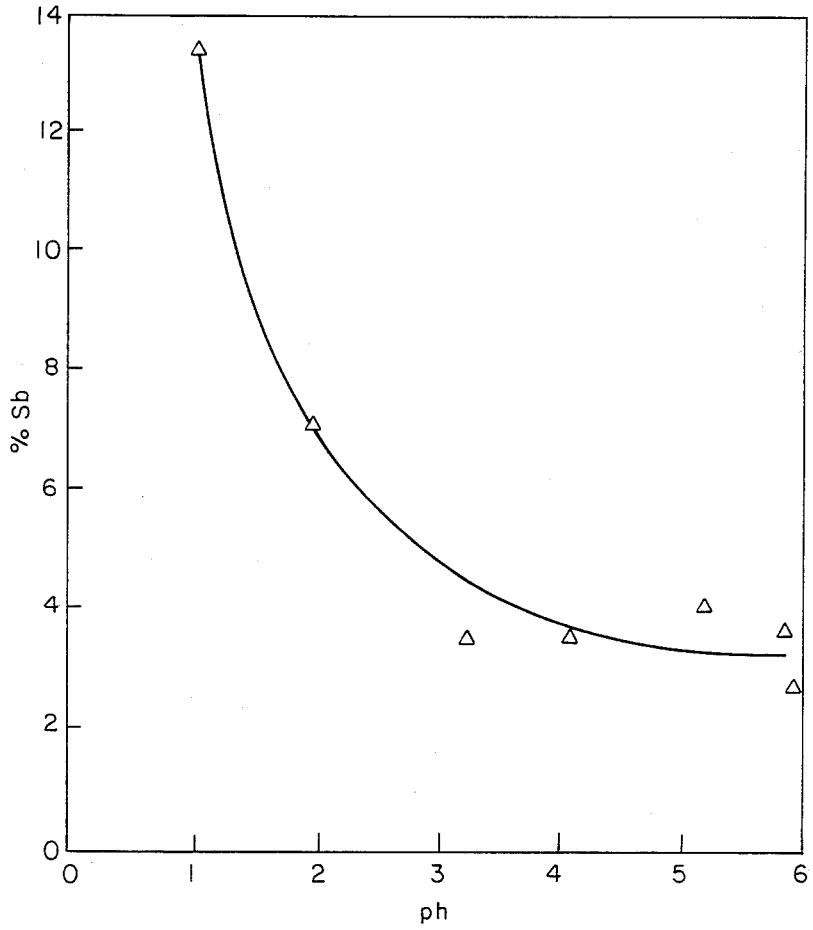
FIG. 3 is a graph showing the composition of the nickel-antimony deposit as a function of pH at a fixed current density and for a specific bath composition.

Nickel antimonide and nickel-antimony alloys present a low cost substitute for gold as an electrical contact material. Coatings or films of these alloys can be deposited, for example, by low cost electrolytic plating techniques. Alternatively, of course, one may use other techniques for preparing such alloys such as sputtering, vapor deposition or vacuum evaporation to form such alloys. An electrolytic plating bath and conditions used for electrolytic plating for the deposition of uniform films of nickel-antimony alloy are taught herein. Further, physical properties and contact resistance of the alloys are shown as well as the hardness and adhesion of some of the alloys.

We have found that utilizing the plating procedures as described herein, nickel-antimony alloys bearing an antimony content of from 1–70% can be prepared. However, we have also found that such alloys containing from 1–20 weight percent antimony are preferred for use as an electrical contact material. Alloys in this limited compositional range are generally more ductile, more metallic (brighter) in appearance and yield more uniform films than alloys having higher antimony contents. Furthermore, compositions with this lower antimony content, i.e., 1–20 weight percent antimony, are generally less expensive to make than compositions with higher antimony contents. The alloys are particularly suitable for use as electrical contacts in such devices as modular telephone jacks, transmitter cups and springs, keypads, lead frame connectors and for contacts in low cost telephones.

We have discovered that the desired nickel-antimony alloy films can be deposited by electroplating from an acidic aqueous solution containing a soluble nickel salt and an alkali metal-antimony salt of a polybasic organic acid. For example, the nickel salt can be nickel sulfate, nickel chloride or nickel sulfamate, nickel sulfate being preferred. Examples of suitable soluble antimony compounds for use in the electroplating bath include alkali metal antimony dibasic acid salts such as potassium antimony oxalate or sodium antimony succinate, alkali metal antimony hydroxy di or tribasic acid salts such as potassium antimony maleate or sodium antimony citrate or potassium antimony tartrate, the latter salt being preferred. The particular films deposited from these electroplating baths will depend not only upon the particular bath constituents employed, but the concentration of antimony in the bath, the bath temperature and pH, the particular current density used for plating and whether or not there is agitation of the bath. As examples of the effects of such parameters, details are given for baths employing a solution of hydrated nickel sulfate ($NiSO_4.6H_2O$) and potassium antimony tatrate $K(SbO)C_4H_4O_6$.

Referring to FIG. 1, the effect of the bath composition on the composition of the electroplated nickel-antimony deposit is shown. The bath composition is expressed by the ratio of the molar concentration of antimony to the molar concentration of nickel in the bath. The deposited nickel-antimony alloy is expressed by the atomic percent antimony as the ordinate of the graph. The results are shown at two current densities, more particularly, 10 milliamps/$cm^2$ and 30 milliamps/$cm^2$ deposited at 70° C. without agitation and at a bath pH of about 2.5. As can be seen from the curves, the percent antimony deposited for a given antimony to nickel ratio is greater at the lower current density. Furthermore, the percent antimony in the deposited film at a given current density is fairly constant at the lower antimony/Ni ratios but changes sharply as the antimony/nickel ratio increases above about $5\times10^{-3}$. We have also found that for this bath the percent antimony in the deposited film is fairly constant for current densities greater than 30 milliamps/$cm^2$ at concentrations of potassium antimony tartrate of $4\times10^{-3}$ mole/liter or less and is also fairly constant at current densities above 50 milliamps/$cm^2$ at potassium antimony tartrate concentrations in the order of $2.7\times10^{-2}$ moles/liter. This effect can be seen with reference to FIG. 2. Also as can be seen, concentration ratios of about $2.7\times10^{-2}$ or less result in deposits having about 20% or less antimony at from 10–30 milliamps.

Referring to FIG. 3, there is shown a graphical representation of the composition of the nickel-antimony deposit as a function of pH of the bath at a fixed current density for a bath composition containing 0.5 moles/-liter $NiSO_4.6H_2O$ and $2\times10^{-3}$ moles/liter of $K(SbO)C_4H_4O_6$. As can be seen from the graph, the amount of antimony in the deposit is a function of the pH for a given bath composition and a given current density of deposition. The current density employed in obtaining the deposits depicted in FIG. 3 was 30 milliamps/$cm^2$. The composition of the deposited alloy stabilizes considerably at a pH of 3 or greater. However, for deposition purposes, the pH should remain less than about pH 6. It may be noted that one may buffer the solution to retain the desired pH by the addition of boric acid or tartaric acid. To maintain good ductility, the pH of the bath should preferably be kept below 3. Hence, as a compromise to achieve uniformity and ductility, pH's of from 2.5 to 3.5 may be employed.

In all of the aforementioned experiments, an inert anode, e.g., a platinum net, was employed.

We have found that the concentration of potassium antimony tartrate in the electroplating solution should not exceed $10^{-1}$ molar as the deposit becomes black and powdery and co-deposition of nickel oxides results. Another parameter which effects the rate of deposition as well as the composition of the deposited film is the degree of agitation. Generally, higher percent antimony deposits are obtained when agitation is increased. The plating rate is also effected by the pH and reaches a maximum rate at pH 4.2.

It may be noted that althouqh the phase diagram of NiSb shows that a solid solution of NiSb consists of a maximum of 9% Sb in Ni, X-ray diffraction patterns indicate that a nickel structure is retained for electrodeposited NiSb films containing up to 15% Sb. However, the lattice parameters vary as the Sb content of the deposit increases.

Figure 4:
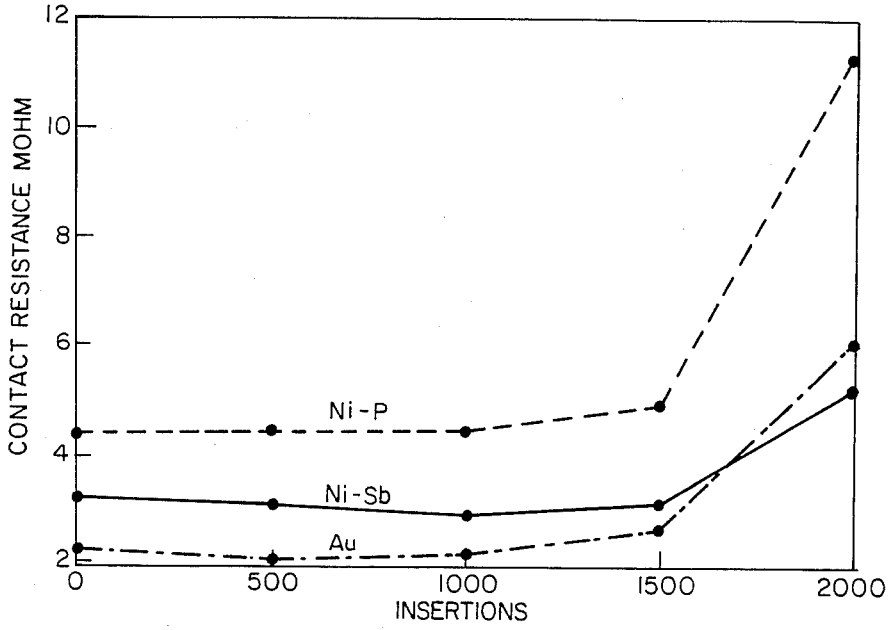
FIG. 4 is a graphical representation indicating the wear of a contact material employed as a contact in a modular telephone jack. The graph is a plot of contact resistance versus the number of insertions of the jack connectors for nickel antimonide, gold and nickel phosphide contact materials.

NiSb films having 8 atomic percent Sb were electrodeposited on copper wire to a thickness of 1 micron in accordance with the aforementioned electrodeposition procedure. The electrodeposition bath comprised 0.5 moles/liter $NiSO_4.6H_2O$ and $2\times10^{-3}$ moles/liter potassium antimony tartrate in a buffered solution held at pH 2.5. Deposition was carried out at a current density of 30 milliamps/$cm^2$. The plated wire was then cut and used in place of the standard wire in a standard modular telephone jack. The point contact resistance of the plated wire was then wear tested by monitoring the resistance as a function of the number of insertions of a plug into the modular jack. Two thousand of such insertions were made and after every 500 insertions the jack was subjected to 19 hours of aging at 150° F. and 90% relative humidity. The results of this test are shown in FIG. 4. For the purposes of comparison, the figure also shows the results of a similar test when using the standard gold plated wire and a nickel phosphide plated wire. As can be seen from the graph, the nickel-antimony plated wire compares favorably with the gold plated wire.

Figure 5:
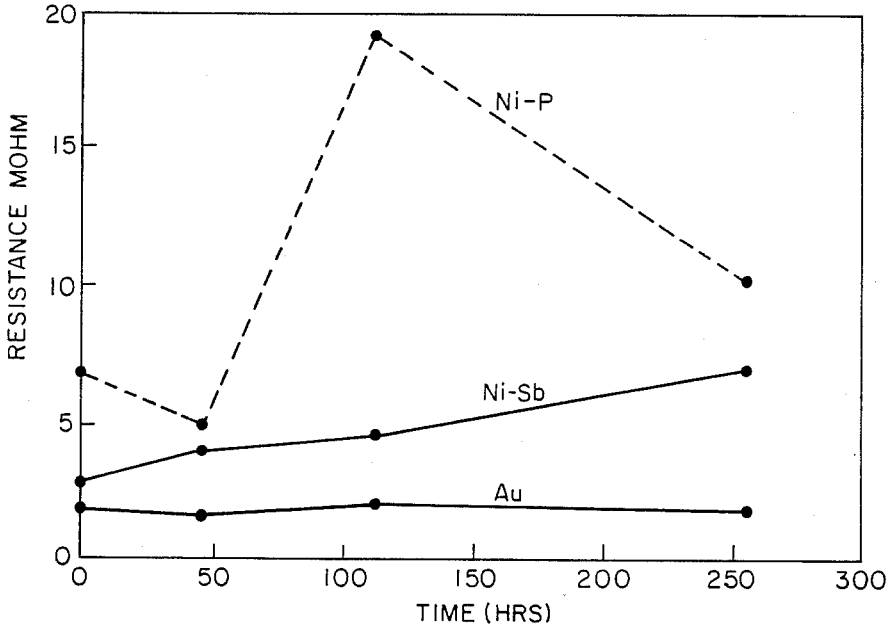
FIG. 5 is a graphical representation of the life or degradation with time of the contact resistance of contacts in a modular telephone jack placed in a high temperature and high humidity environment to accelerate life testing. The graph is a plot of the electrical resistance of the contact material as a function of time for nickel-antimony alloy gold and nickel phosphide.

In addition to the aforementioned tests the resistance of the wire was monitored with respect to time with the wire being exposed to a temperature of 150° F. and a relative humidity of 90% for up to 250 hours. FIG. 5 shows the results of these tests and compares the results of the nickel-antimony coated wires with that of the standard gold plated wire and with a nickel phosphide plated wire. Again, as can be seen from the graph, the nickel-antimony plated wire compares favorably with respect to the gold plated wire.

What is claimed is:

1. A method of depositing an alloy of nickel and antimony on a substrate comprising from 1 to 70 weight percent antimony and the balance nickel comprises electroplating said alloy from an acidic solution comprising a soluble nickel salt and a soluble mixed alkali metal-antimony salt of a polybasic organic acid wherein said substrate is made the cathode.

2. The method recited in claim 1 wherein the resultant deposit contains from 1 to 20 weight percent antimony.

3. The method recited in claim 1 wherein the nickel salt is selected from the group consisting of nickel sulfate, nickel chloride and nickel sulfamate.

4. The method recited in claim 1 wherein the antimony-containing salt is selected from the group consisting of potassium-antimony and sodium-antimony salts of oxalic, succinic, maleic, citric and tartaric acids.

5. The method recited in claim 4 wherein the soluble nickel salt is selected from the group consisting of nickel sulfate, nickel chloride and nickel sulfamate.

6. The method recited in claim 1 wherein the solution comprises nickel sulfate and an alkali metal-antimony tartrate.

7. The method recited in claim 6 including a buffer.

8. The method recited in claim 7 wherein said buffer is selected from the group consisting of boric acid, tartaric acid and mixtures thereof.

9. The method recited in claim 6 wherein the ratio of the molar concentration of Sb to Ni in the solution is no greater than $2.7\times10^{-2}$.

10. The method recited in claim 6 wherein the antimony/nickel molar ratio in the solution is about $4\times10^{-3}$ or less.

11. The method recited in claim 6 wherein the electroplating current density is at least 30 ma/cm$^2$.

12. The method recited in claim 6 wherein the concentration of the alkali metal-antimony tartrate is less than about $10^{-1}$ moles per liter.

13. The method recited in claim 1 wherein the pH of the solution is from 1–6.

14. The method recited in claim 1 wherein the pH of the solution is from about 2.5 to 3.5.

15. A method for depositing an alloy of nickel and antimony on a conductive substrate said alloy comprising from 1 to 20 weight percent antimony comprising electroplating the desired alloy onto said substrate which substrate is made the cathode of an electrolytic cell, the anode of which is inert and wherein the plating solution comprises a soluble nickel salt and a soluble alkali metal-antimony tartrate in a molar concentration ratio of Sb/Ni of no more than $2.7\times10^{-2}$ together with a buffer to maintain the pH of said solution in a range of from 2.5 to 6 and wherein electroplating is done at current densities of at least about 30 ma/cm$^2$.

16. The method recited in claim 15 wherein said buffer is selected from boric acid, tartaric acid and mixtures thereof.

17. The method recited in claim 15 wherein the tartrate concentration is less than 0.1 moles per liter.

18. The method recited in claim 17 including agitating the solution during deposition while maintaining the solution at a somewhat elevated temperature.

* * * * *

UNITED STATES PATENT AND TRADEMARK OFFICE

CERTIFICATE OF CORRECTION

PATENT NO. : 4,518,469

DATED : May 21, 1985

INVENTOR(S) : S. L. NG, J. T. PLEWES and M. ROBBINS

It is certified that error appears in the above—identified patent and that said Letters Patent is hereby corrected as shown below:

On the title page, under the heading "Assignee", "AT&T Technologies, Inc., New York, New York", should read --AT&T Technologies, Inc., New York, New York and AT&T Bell Laboratories, Murray Hill, New Jersey--

Column 3, line 64, "althouqh" should read -- although --.

Signed and Sealed this

*Fifth* Day of *November 1985*

[SEAL]

*Attest:*

*Attesting Officer*

DONALD J. QUIGG

*Commissioner of Patents and Trademarks*